US005544501A

United States Patent [19]

Hägel

[11] Patent Number: 5,544,501

[45] Date of Patent: Aug. 13, 1996

[54] KNITTING NEEDLE FOR A CHAINSTITCH KNITTING MACHINE

[75] Inventor: Adolf Hägel, Bad Steben, Germany

[73] Assignee: Liba Maschinenfabrik GmbH, Naila, Germany

[21] Appl. No.: 420,074

[22] Filed: Apr. 11, 1995

[30] Foreign Application Priority Data

Apr. 14, 1994 [DE] Germany ..... 44 14 703.1

[51] Int. Cl.[6] ..... D04B 35/04

[52] U.S. Cl. ..... 66/124

[58] Field of Search ..... 66/124

[56] References Cited

U.S. PATENT DOCUMENTS

| | | | |
|---|---|---|---|
| 348,088 | 8/1886 | Worrall | 66/114 |
| 1,221,806 | 4/1917 | Scott | 66/124 |
| 1,496,341 | 6/1924 | Kochenderfer | 66/114 |
| 2,024,911 | 12/1935 | Crawford | 66/124 |
| 3,977,217 | 8/1976 | Ross | 66/124 |
| 5,097,683 | 3/1992 | Schüler | 66/124 X |

FOREIGN PATENT DOCUMENTS

| | | | |
|---|---|---|---|
| 236021 | 9/1964 | Austria | 66/124 |
| 1234351 | 2/1967 | Germany | 66/124 |

*Primary Examiner*—John J. Calvert
*Attorney, Agent, or Firm*—Bardehle & Partners

[57] ABSTRACT

A knitting needle for a chainstitch knitting machine is disclosed wherein protuberances are introduced into the shank of the needle in order to prevent the needle from changing its position within a groove of the needle bar so that the needle hooks maintain an even distance between each other to avoid flaws in the knitted material such as striping. The protuberances are impressed into the material of the shank of the needle by pressing tools. In one embodiment, three protuberances are pressed into the shank to thereby create a three point abutment on one side of the shank against one wall of the groove, while the other side of the shank abuts against the other wall of the groove. In another embodiment, wave-like through bends are created which create linear bends normal to the longitudinal extent of the needle shank. this will assure a linear abutment of the protuberance against one wall of the groove rather than a point contact. In another embodiment, a longitudinal bend or elevation has been introduced in a longitudinal extent of the needle shank assuring a longitudinal contact with one wall of the groove. All embodiments assure that all needles cannot elastically deform in the middle of their respective shank or cannot move to an oblique position within a groove.

11 Claims, 3 Drawing Sheets

KNITTING NEEDLE FOR A CHAINSTITCH KNITTING MACHINE

The invention is concerned with a knitting needle for a chain-stitch knitting machine having been formed from a flat metal strip including a needle shank which can be inserted into a groove of a needle bar and can be fastened therein.

When assembling a knitting machine, most of the knitting needles are inserted into the needle bar individually. The same applies, when in operation, a damaged knitting needle has to replaced. This insertion of a knitting needle mandates that their shanks exhibit a certain undersize relative to the width of the grooves. The larger this undersize is, the greater is the play of the shank within the groove, resulting in that the relative distance varies between the hooks of the knitting needles which under some circumstances causes a striping of the manufactured knitted material and thereby creates a loss because of inferior quality.

A high exactitude of the distances between the needle grooves, meaning, the gauge of the needle bar and the width of the grooves, (tolerance of 0,003 mm) can be obtained in a corresponding machining of the needle bar and its grooves without any difficulties. It is also possible to manufacture the knitting needles in greater numbers in one run from a roll of metal strips which is available for the complete run. However, experience has shown that unavoidable tolerance variations are occurring in the metal thicknesses from one run to another in the order of amounts of 0,02 mm.

In order to equalize the substantial thickness differences, the needle grooves have been machined by special tools so that they correspond to the actual thickness of a particular run being fitted into a needle bar. This results in substantial machining and manufacturing efforts, but also creates a problem when damaged needles have to be replaced because needles of the same run are not always available. In this case, when supplying needles having a shank that is too thin, the result is that a needle with such a shank in a groove experiences too much play and consequently positions itself obliquely to the longitudinal direction of the groove. Such an example is being described in DE-PS 26 55 269 and indicates a solution to the problem of a possible rotation of the needle shank around its longitudinal axis which is done by a special off-set of the needle shank. However, a solution of the problem of an oblique positioning of the needle shank in the longitudinal groove, which results in the above mentioned irregular distances of the needle hooks, Has not been indicated.

Therefore, an object of the invention is to safeguard the oblique positioning of the needle shank in a sure manner. According to the invention this is accomplished in that the needle shank is deformed in such a manner that in at least two adjacent positions elevations are provided which in their maximum dimension together with the thickness of the shank exhibit an undersize of (smaller than 0,02 mm) when compared to the given width of the groove.

When deforming the needle shank, one achieves that in at least two adjacent positions elevations are provided having predetermined exactitudes which abut themselves against one wall of the groove, while the flat sides on the opposite side of the elevations of the needle shank abut against the other wall of the groove. Because of the small tolerance of the maximum dimension together with the thickness of the shank a very exact fitting of the needle shank within the groove having already been provided with a high dimensional exactitude, is guaranteed. It is further guaranteed that when inserting a needle shank into a groove, just sufficient play is available for that purpose which, however, is so minimal that the needle shanks have no possibility to position themselves obliquely to the longitudinal direction of the grooves. This then guarantees, furthermore, the exactitude and evenness of the distance between the needle hooks.

The elevations can preferably be formed as arches pushed into the material. Such arches can be manufactured by placing the needle shank on a stencil having corresponding depressions therein and by pressing a stamp having corresponding elevations thereon against the needle shank. Such arches are preferably provided at each end region of the shank and also in its middle so that once installed in a groove, the three arches or elevations will abut against one wall of the groove and with its opposite side against the other wall of the groove. In view of the fact that the needle shank is formed in this manner, an elastic bending in the middle area of the shank is avoided because of the support afforded there by the presence of an elevation. The arches can be formed as substantial round elevations whereby a pressing stamp is required having ball-like protuberances as pressure areas matching corresponding depressions in the stencil. It is also contemplated to form the elevations as wave-like protruding bends which will extend normal to the length of the shank. In this case, the pressing stamp includes an upper surface similar to a rounded roof. With this embodiment, a linear abutment against a corresponding wall of the groove is obtained, which is in contrast to the point-like abutments.

In still another kind of manufacture of the elevations, one imparts a longitudinal bend in the longitudinal direction of the needle shank. In this case, the needle shank abuts with its one side against one wall of the groove by way of two edges formed by the ends of the longitudinal bend and on its other side abuts against the other wall of the groove with the middle of the longitudinal bend.

Normally, the manufacture of the height of the elevations can be undertaken with considerable exactitude by using precision pressing tools. However, should these exactitudes be insufficient, preferably, the predetermined dimension can be obtained thereafter by working the same such as by abrading resulting in an exactitude of, for example, an undersize of 0,003 mm.

DETAILED DESCRIPTION OF THE DRAWINGS

Figure 1:
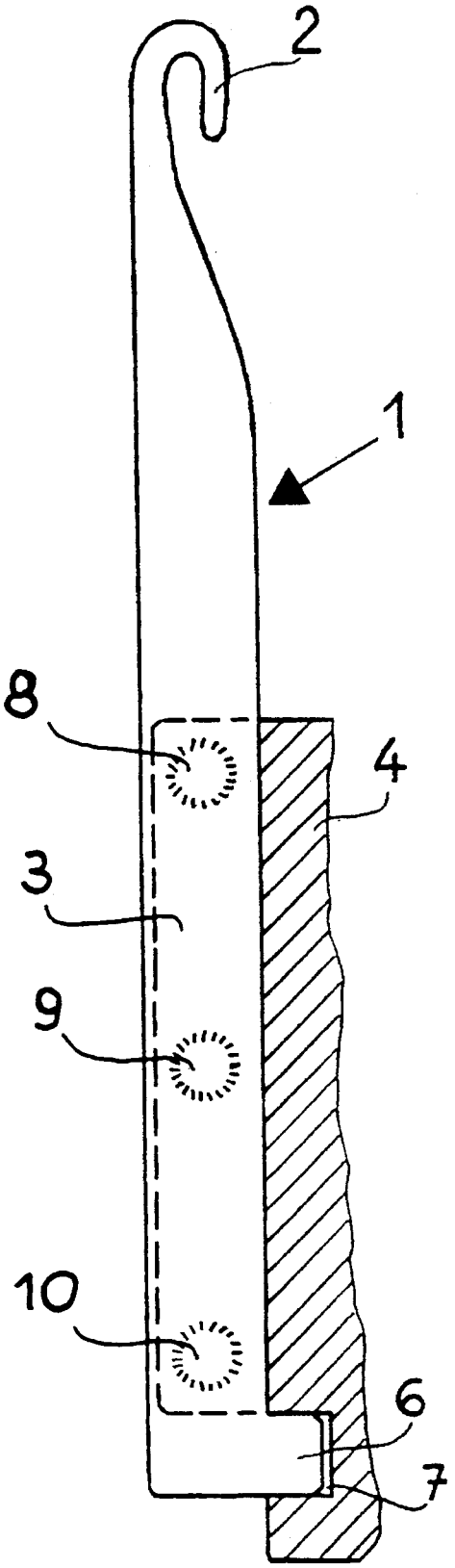
FIG. 1 shows a knitting needle in side view having round protuberances forming elevations.

FIG. 1 shows a knitting needle 1 having a hook 2 and a needle shank 3 which has been inserted into a groove of needle bar 4. (The Groove 5 can be seen in FIG. 2). The needle shank 3 ends in a needle foot 6 which is inserted in a corresponding cross-slot 7 of needle bar 4 and arrested therein in a longitudinal direction.

In the area of the reception of the needle shank 3 in the groove 5, (see FIG. 3) the needle shank has been provided with three through bends which here have been formed as round protuberances 8, 9 and 10. Thereby, the protuberances 8 and 9 are located at the ends of the area of the reception of the shank, while protuberance 9 is located in the middle there between.

Figure 2:
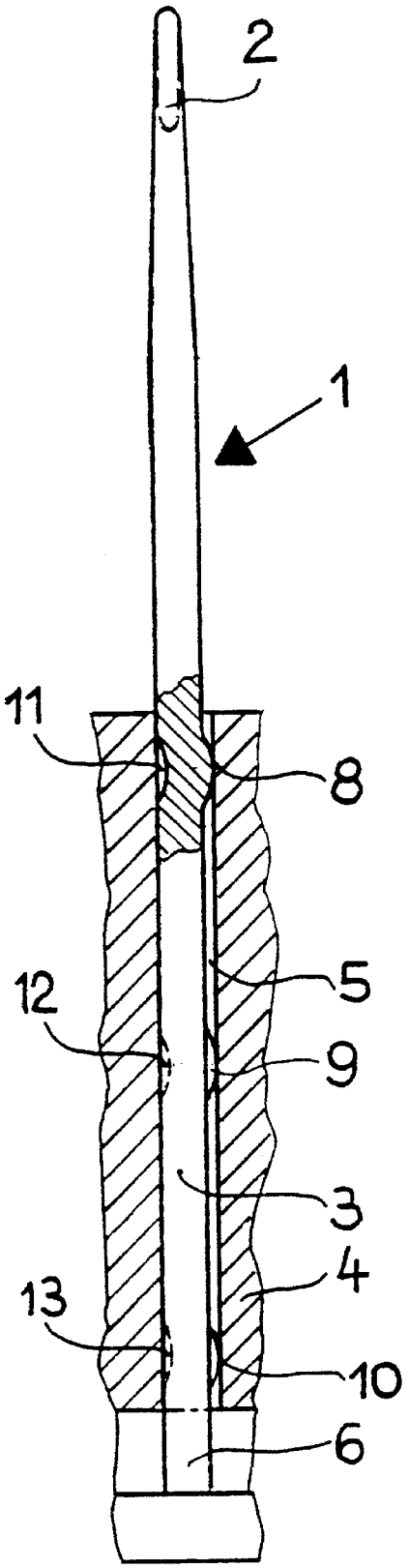
FIG. 2 shows the same knitting needle in a front view.

FIG. 2 shows a knitting needle 1 according to FIG. 1 in a frontal view wherein the needle hook 2 is averted from view. The shank 3, over most of its length, is received in the groove 5 of needle bar 4. In the area of the groove 5, the shank 3 has round protuberances 8, 9 and 10 and having oppositely situated three depressions 11, 12 and 13 on the other side of the shank. These depressions 11, 12 and 13 were created when the round protuberances were formed, namely in that the needle 1 was placed flatly on a stencil having corresponding depressions and thereafter was pressed with a corresponding pressing stamp. The stamp, thereby, forms the depressions in a known manner.

As can be seen, the side of the knitting needle having the depressions 11, 12 and 13 fully abuts against the corresponding wall of the groove 5, while on the opposite side, the protuberances 8, 9 and 10 are abutting against the other wall. The protuberances 8, 9 and 10, while considering the thickness of the material, are of such a height so that the thickness together with the height of the protuberances exhibits a very small undersize when compared to the width of the groove 5, which has been manufactured within a tolerance of less 0,01 mm. Therefore, the play remaining in the groove is practically only 0,01 mm which in practice is too minimal to have any influence over the positioning of the needle hook 2 when, during its course of operation, the needle 1 is moved to and fro within groove 5, meaning, that the needle hooks could be moved to and fro within the plane of the drawing of FIG. 2, which is practically impossible. In this manner it is achieved that the pusher needle 1, before as well as after, can still be individually inserted into groove 5 without fear of detrimental movements.

Figure 3:
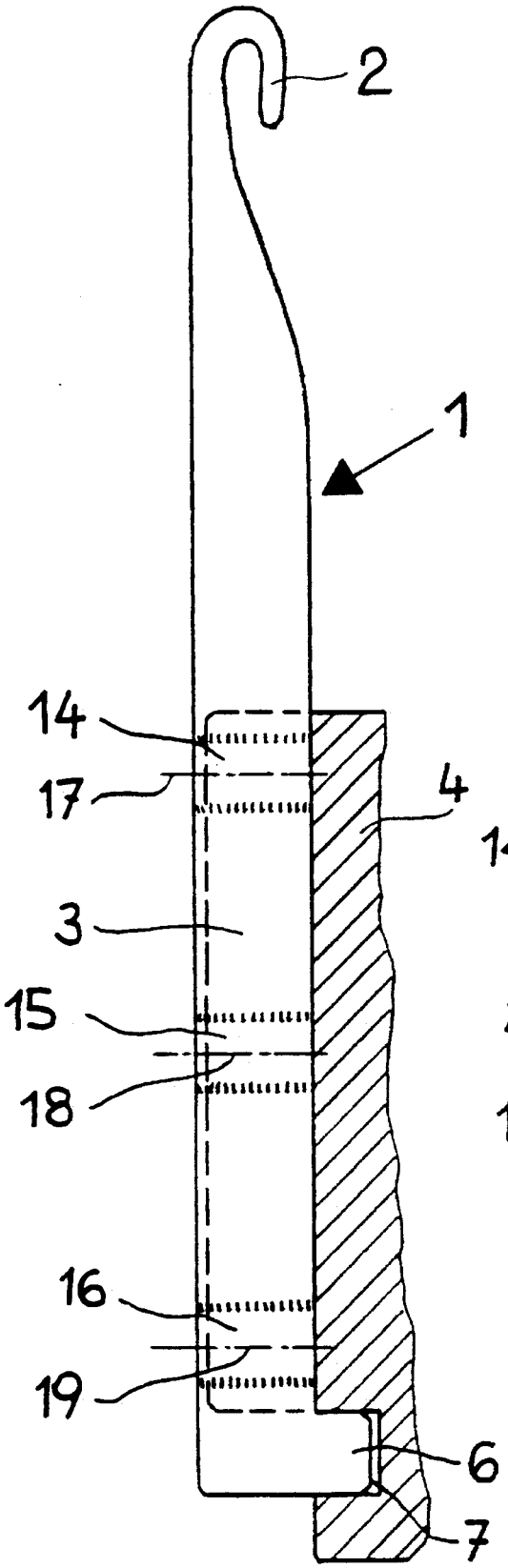
FIG. 3 shows a knitting needle in side view and having wave-like bends forming elevations.

FIG. 3, in principal, shows a knitting needle 1 constructed in a similar manner as in FIGS. 1 and 2 with the exception that the three elevations in FIG. 3 have been formed as wave-like through bends 14, 15 and 16. These through bends extend normal to the needle shank and thereby on the side of their elevations form linear abutments 17, 18 and 19 which is in contrast to the elevations according to FIGS. 1 and 2 making point-like contacts.

Figure 4:
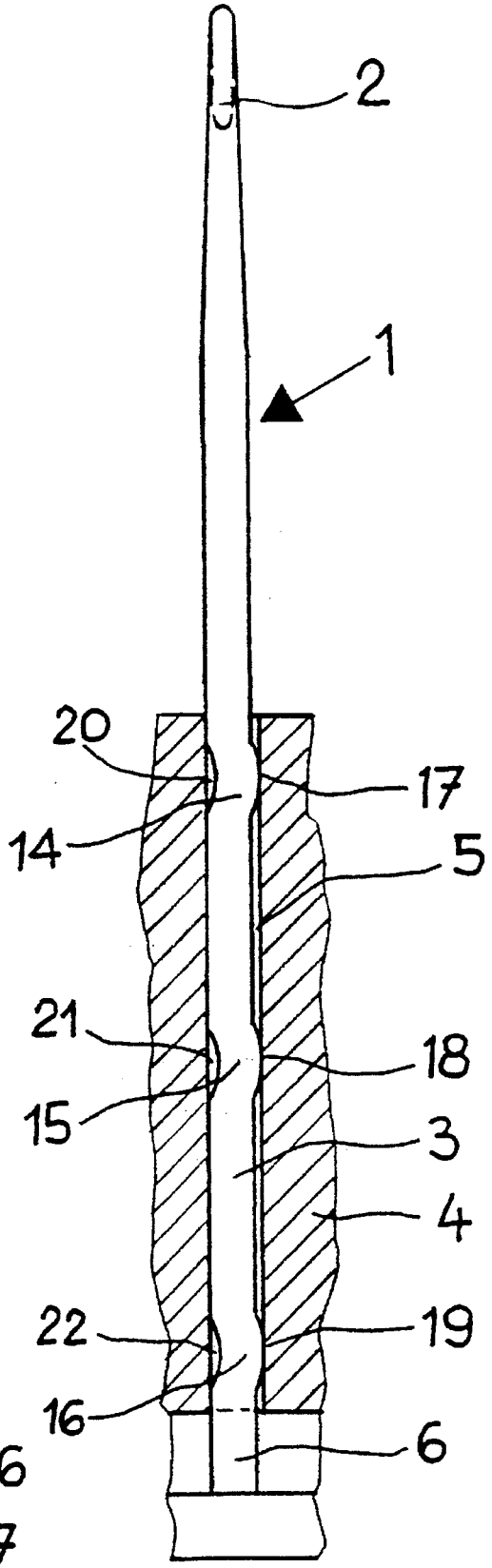
FIG. 4 shows the same knitting needle as in FIG. 4 in front view.

FIG. 4 is a view of a knitting needle 1 according to FIG. 3 but having been rotated by 90° and the form of the wave-like through bends can be discerned which again extend normal to the needle shank. The depressions 20, 21 and 22 formed oppositely from the elevations 17, 18 and 19 were created when the through-bends 14, 15 and 16 were formed as by pressing with a corresponding pressing stamp.

Figures 5, 6:
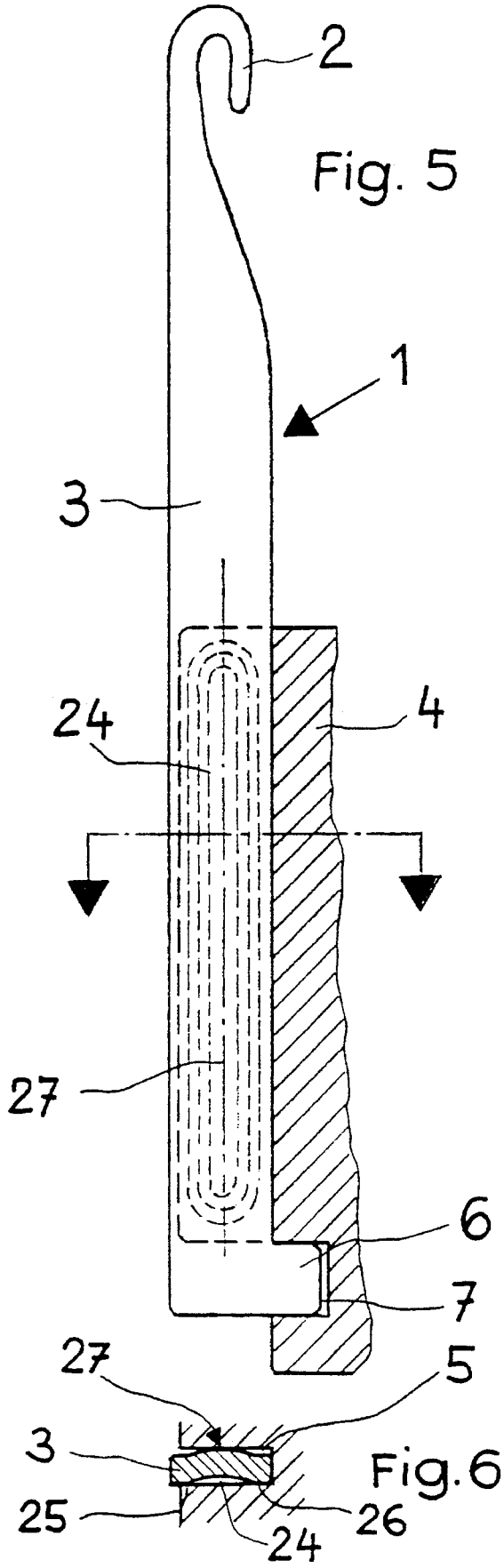
FIG. 5 shows a knitting needle in side view having a longitudinal bend.
FIG. 6 shows a cut along lines A—A in FIG. 5.

FIG. 5 shows a knitting needle 1 which basically corresponds to the structure according to FIGS. 1 to 4 with the exception, however, that the needle shown in FIG. 5 exhibits a shallow longitudinal arch in the longitudinal direction of shank 3. the longitudinal arch can clearly be seen in FIG. 6 which is shown as a cut along line A—A in FIG. 5 As can be seen, the needle shank on one hand abuts with both ends 25 and 26 against one wall of the groove 5 and on the other hand with its convex part of its longitudinal arch against the other side of groove 5.

The illustrated elevations (protuberances 8, 9 and 10; 14, 15 and 16; longitudinal arch 24) are of a minimal height relative to the corresponding upper surface of the needle shank. This height is about 0,05 mm.

The exact required height, in case it has not been fully obtained during the pressing operation, can retroactively be corrected by abrading the elevations in case of an oversize. by abrading the elevations, a sufficient exactitude can be maintained in connection with the overall dimension of the needle shanks.

I claim:

1. A needle for a warp knitting machine having a needle bar, the needle comprising: a hook, and a needle shank for insertion into a groove of the needle bar and for fastening therein, wherein said needle shank has at least two elevations on one side of the shank distant from the hook, the dimension of one of said elevations together with the thickness of said shank being at most 0.01 mm less than a given width of said groove, wherein the side of the needle shank opposite the elevations fully abuts side of the groove except for areas opposite the elevations, and the elevations abut against an opposite side of the groove.

2. A knitting needle according to claim 1, wherein said elevations (8, 9 10; 14, 15, 16) comprise arches.

3. A knitting needle according to claim 2, further comprising an arch in a middle of said shank.

4. A knitting needle according to claim 1, wherein said elevations are comprised of substantially round protrusions.

5. A needle for a chainstitch knitting machine having a needle bar with grooves for needles, the needle comprising:

a shank having first and second sides for insertion into a groove of the needle bar and fastening in the needle bar wherein said first side of said shank substantially abuts a side of the groove, and said second side having one or more elevations protruding therefrom, wherein the combined thickness of said shank and one of said elevations is between about the groove width and about 0.2 mm less than the groove width.

6. A needle as in claim 5, wherein the combined thickness of said shank and one of said elevations is between about the groove width and about 0.01 mm less than the groove width.

7. A needle as in claim 5, wherein the combined thickness of said shank and one of said elevations is between about the groove width and about 0.003 mm less than the groove width.

8. A needle as in claim 5 comprising first and second elevations, wherein said elevations are positioned at opposite ends of said shank for contact with opposite ends of a side of the groove.

9. A needle as in claim 5 comprising one elevation, wherein said elevation is an arch.

10. A needle as in claim 5 wherein one of said elevations is a substantially round protrusion.

11. A needle as in claim 5 comprising three elevations protruding from the second side of said shank.

* * * * *

UNITED STATES PATENT AND TRADEMARK OFFICE

CERTIFICATE OF CORRECTION

PATENT NO. : 5,544,501
DATED : August 13, 1996
INVENTOR(S) : Adolf Hagel

It is certified that error appears in the above-indentified patent and that said Letters Patent is hereby corrected as shown below:

In column 4, claim 5, line 40, replace "0.2mm" with --0.02mm--.

Signed and Sealed this

Eighteenth Day of February, 1997

*Attest:*

*Attesting Officer*

BRUCE LEHMAN

*Commissioner of Patents and Trademarks*